US005511043A

United States Patent [19]

Lindberg

[11] Patent Number: 5,511,043

[45] Date of Patent: Apr. 23, 1996

[54] MULTIPLE FREQUENCY STEERABLE ACOUSTIC TRANSDUCER

[75] Inventor: Jan F. Lindberg, Norwich, Conn.

[73] Assignee: The United States of America as represented by the Secretary of the Navy, Washington, D.C.

[21] Appl. No.: 417,544

[22] Filed: Apr. 6, 1995

[51] Int. Cl.[6] ..... H04R 17/00

[52] U.S. Cl. ..... 367/155; 367/103; 367/119; 310/334

[58] Field of Search ..... 367/153, 155, 367/103, 119; 310/334

[56] References Cited

U.S. PATENT DOCUMENTS 4,805,157 2/1989 Ricketts ..... 367/119
4,870,867 10/1989 Shaulov ..... 73/625
5,410,205 4/1995 Gururaja ..... 310/328

*Primary Examiner*—J. Woodrow Eldred
*Attorney, Agent, or Firm*—Michael J. McGowan; Michael F. Oglo; Prithvi C. Lall

[57] ABSTRACT

A multiple frequency acoustic transducer is constructed as a stacked configuration of N groups of multi-layer transducer elements separated from one another by an electrical insulating material. Each multi-layer transducer element in an n-th one of the N groups has a layer of acoustically transparent electroacoustic transducer material whose thickness is determined by the n-th frequency of operation. Each multi-layer transducer element has opposing planar surfaces with electrically conductive material deposited thereon. For each multi-layer transducer element, the electrically conductive material is formed into parallel strips electrically isolated from one another on at least one of each element's opposing planar surfaces. The parallel strips associated with each multi-layer transducer element in any one of the n-th groups have a unique angular orientation in the n-th group.

13 Claims, 4 Drawing Sheets

MULTIPLE FREQUENCY STEERABLE ACOUSTIC TRANSDUCER

STATEMENT OF GOVERNMENT INTEREST

The invention described herein may be manufactured and used by or for the Government of the United States of America for Governmental purposes without the payment of any royalties thereon or therefor.

CROSS-REFERENCE TO RELATED PATENT APPLICATIONS

This patent application is co-pending with one related patent application entitled Steerable Acoustic Transducer (Navy Case No. 75009) by the same inventor as this patent application.

BACKGROUND OF THE INVENTION (1) Field of the Invention

The present invention relates generally to acoustic transducers, and more particularly to acoustic transducers that can generate/detect beams of acoustic energy for a plurality of frequencies.

(2) Description of the Prior Art

Acoustic transducers are devices which generate acoustic energy when excited in a known fashion and/or generate an electrical signal representative of the acoustic energy incident upon the transducer. For example, one prior art single array piezoelectric ceramic transducer 10 is shown in the frontal plan view of FIG. 1 and cross-sectional view of FIG. 2. Transducer 10 includes piezoelectric ceramic material 12 disposed between metallic layers 16*a*,16*b* which are deposited on top and bottom surfaces 12*a*,12*b* of material 12. Notches, represented by lines 18, are cut in a hatched pattern through metallic layers 16*a*,16*b* and into a portion of piezoelectric ceramic material 12 to define an array of pillars 20*a*,20*b* capped with metal electrodes 22*a*,22*b* formed on surfaces 12*a*,12*b*. The surfaces presented by the arrays of electrodes 22*a* or 22*b* can serve as the front face plane of transducer 10. Each metal electrode 22*a*,22*b* is electrically isolated from adjacent electrodes. The pattern of notches 18 is optimally sized so that the width of each pillar 20*a*,20*b* is approximately 0.5λ where λ is the wavelength in the transmission medium of the acoustic energy being generated or received. Metal electrodes 22*a* are electrically interconnected to one another (not shown for ease of illustration) and connected to electrical lead 24*a*. In a similar fashion, metal electrodes 22*b* are electrically interconnected to one another and then connected to electrical lead 24*b*.

The acoustic energy generated by such a transducer is a narrow beam normal to the front face plane of the transducer and is sometimes referred to as a boresight beam. The shape and size of the beam is dependent upon several factors which include overall size of the transducer, the frequency of excitation or reception, and the existence of shading induced by selectively suppressing the level of excitation or reception along the peripheral area of the transducer.

To generate/detect acoustic energy over a variety of azimuth and elevation angle combinations relative to the front face plane of a transducer, it is necessary to "steer" the boresight beam. In other words, the acoustically active portion of the front face plane must be controlled. To accomplish boresight beam steering, the entire transducer can be moved mechanically or the electrodes can be electronically steered by energizing the electrodes in accordance with a specific sequencing technique known in the art as phasing. Mechanical movement of the transducer involves slow, complex mechanisms. Electronic steering of transducer 10 requires each metal electrode 22*a*, 22*b* to have an individual electric lead attached thereto so that the outgoing beam can be steered along particular angles of azimuth and elevation relative to the front face plane or so that an incoming beam's angular resolution can be detected relative to the front face plane. However, implementing such individual connection is especially difficult and impractical when the transducer is designed for high-frequency operation. For example, a conventional high-frequency acoustic array of 400 electrodes (e.g., a 20×20 planar array) requires an electrical connection to each of the 400 electrodes of the array in order to have a steerable and controllable array. Thus, the front face plane of the array, i.e., the part that is emitting/receiving acoustic energy into/from the transmission medium, is a maze of 400 wires—one for each of the 400 individual electrodes. The conducting portion of each wire must be affixed to an individual electrode while the insulated portion of the wire must be routed to a connector or junction box. The wires can disrupt the acoustic beam being generated/received by the array and create an anisotropic volume above the array. Further, if such an array were built for a 250 kHz signal, the entire array would only measure about one inch across.

Another prior art approach to beam steering is disclosed in U.S. Pat. No. 4,202,050 where four sets of spirally stacked, linear arrays of individual piezoelectric crystals are used in conjunction with an electronic phasing signal generator/detector. However, operation of the device at high-frequency requires the use of arrays that are several feet in length. Such sizing is not practical for many devices requiring small acoustic transducers.

It is also often necessary to generate/detect acoustic energy over a variety of frequencies. For example, it may be necessary to determine the dependency of the beam's propagation distance upon the environment in which the acoustic energy is traveling. Typically, multiple single-frequency transducers are used to handle operation over a variety of frequencies. When using multiple ceramic transducers, e.g., multiples of transducer 100, the transducers must be arranged such that one transducer does not block the signal from any other transducer. This can be accomplished by varying the sizes of the transducers or spreading out the transducers. However, varying the sizes of the transducers always results in one or more frequencies having a lower sensitivity while spreading out the transducers requires additional space. Further, to date, multiple transducer designs lack symmetry about an axis of transmission/reception thereby complicating the signal processing associated therewith.

SUMMARY OF THE INVENTION

Accordingly, it is an object of the present invention to provide an acoustic transducer capable of generating and detecting acoustic energy for a plurality of frequencies.

Another object of the present invention is to provide an acoustic transducer capable of operation in accordance with well known electronic beam steering and beamforming techniques.

Still another object of the present invention is to provide an easily produced acoustic transducer capable of generating and detecting high-frequency acoustic energy for a plurality of frequencies.

Yet another object of the present invention is to provide a small acoustic transducer for generating and detecting acoustic energy for a plurality of frequencies that lends itself to thin-film fabrication.

Still another object of the present invention is to provide an acoustic transducer for generating and detecting acoustic energy for a plurality of frequencies that is symmetrical with respect to all angles of transmission and reception.

Other objects and advantages of the present invention will become more obvious hereinafter in the specification and drawings.

In accordance with the present invention, a multiple frequency acoustic transducer is constructed as a stacked configuration of N groups of multi-layer transducer elements separated from one another by an electrical insulating material. Each multi-layer transducer element in the n-th one of the N groups has a layer of acoustically transparent electro-acoustic transducer material whose thickness is determined as a function of the speed of sound in the layer and the desired frequency of operation for the n-th one of the N groups. Each multi-layer transducer element has opposing planar surfaces with electrically conductive material deposited thereon. For each multi-layer transducer element, the electrically conductive material is formed into parallel strips electrically isolated from one another on at least one of each element's opposing planar surfaces. The parallel strips associated with each multi-layer transducer element in an n-th one of the N groups have a unique angular orientation within the n-th one of the N groups.

BRIEF DESCRIPTION OF THE DRAWINGS

Other objects, features and advantages of the present invention will become apparent upon reference to the following description of the preferred embodiments and to the drawings, wherein.

DESCRIPTION OF THE PREFERRED EMBODIMENT(S)

Figure 3:
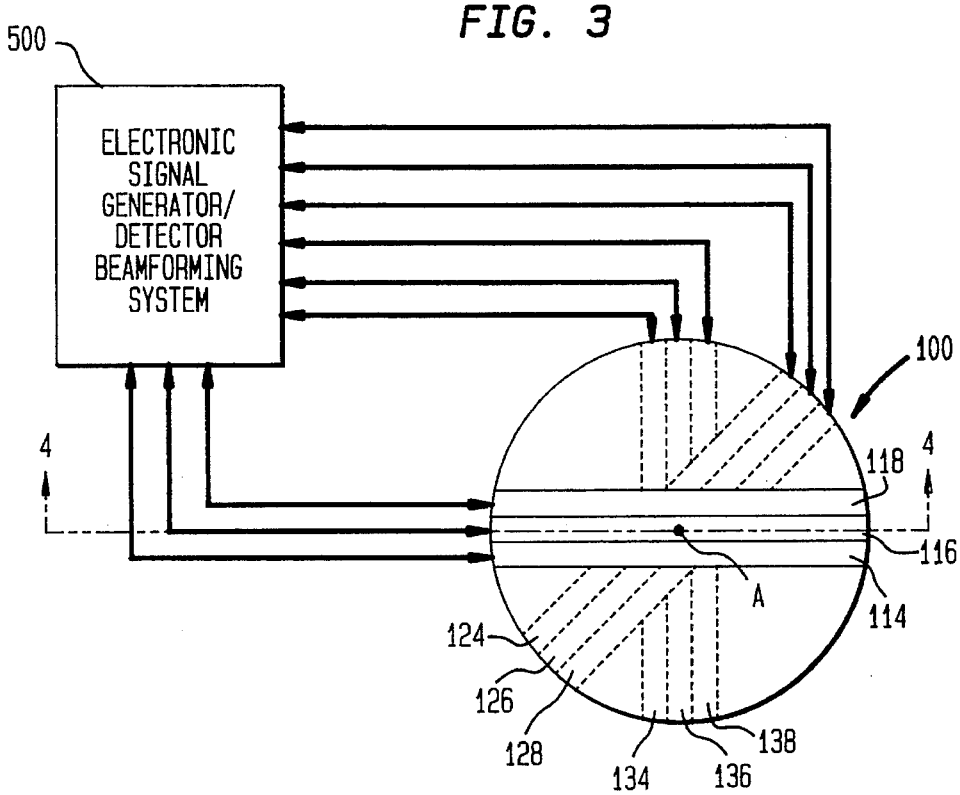
FIG. 3 is in part a frontal plan view of an embodiment of a multiple layer steerable acoustic transducer and in part a block diagram of a generator/detector beamforming system according to the present invention.
Figure 4:
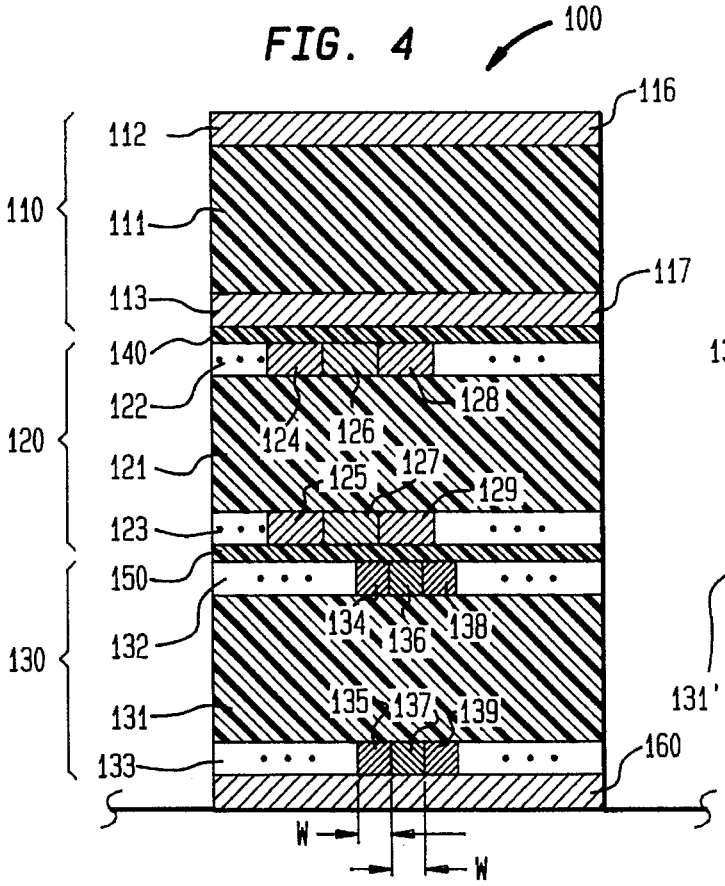
FIG. 4 is a somewhat diagrammatic (with the thickness of the layers exaggerated), cross-sectional view of the multiple layer steerable acoustic transducer taken along line 4—4 of FIG. 3.

Referring now to the drawings, and more particularly to FIGS. 3 and 4, an illustrative example of the steerable acoustic transducer according to the present invention will be described. In the illustrative example, transducer 100 has three transducer elements 110, 120 and 130 for generating/detecting acoustic energy at any or all of the angles of elevation along each of three uniquely oriented hemispherical planes of sensitivity. Each hemispherical plane of sensitivity is normal to the transducer's surface but is uniquely oriented in terms of azimuthal angle as will be described below.

The aforesaid term "hemispherical plane" is common vernacular of persons skilled in the art of acoustically detecting or tracking undersea targets. It's meaning is defined as a plane perpendicular to the frontal plane of the transducer apparatus passing through a reference origin point which is the origin of a hypothetical hemisphere superposed over the frontal plane. The angular positions of the plane about the reference origin point is referred to as the azimuthal angle. Two-dimensional acoustic beam patterns are then depicted as polar coordinate type curves in such hemispherical planes. It will be understood by one skilled in the art that the present invention can include additional transducer elements to provide a larger number of such hemispherical planes of sensitivity. In general, the transducer of the present invention can generate/detect acoustic energy at any or all of the angles of elevation for a number of azimuthal angles equal to the number of transducer elements.

More specifically, transducer 100 is shown in a plan view in FIG. 3 and in cross-section in FIG. 4 which has been taken along line 4—4 of FIG. 3. Like reference numerals refer to common elements between the two views. In one embodiment, transducer 100 is formed as a stacked structure. Thin-film transducer elements 110, 120 and 130 bonded into a unitary structure. In the embodiment shown, transducer elements 110 and 120 are separated by electrical insulating film 140, and transducer elements 120 and 130 are separated by electrical insulating film 150. The active component in each of transducer elements 110, 120 and 130 is layer 111, 121 and 131, respectively. Each of layers 111, 121 and 131 is an active polymer which (i) has polarized piezoelectric characteristics in its thickness dimension, and (ii) is acoustically transparent within the desired range of operating frequencies. Examples of materials having these characteristics include, but are not limited to: (i) polyvinylidene fluoride (also known in the art as $PVF_2$ or PVDF) which is a commercially available homopolymer; and (ii) polyvinylidene trifluoroethylene which is a copolymer available from Amp, Inc., Valley Forge, Penna. Other suitable materials include acoustically transparent electrostrictive materials such as urethane or nylon, or any other acoustically transparent material having characteristics exploitable to provide transducing action between acoustic and electrical signals. Any one of the afore-mentioned suitable materials for layers 111, 121 and 131 may be referred to hereinafter in the specification and appended claims by the general collective term "acoustically transparent electro-acoustic transducer material".

On the one and the other of the planar faces of each of layers 111, 121 and 131, electrically conductive electrode materials (e.g., gold, silver, copper, or other conducting metal) 112 and 113, 122 and 123 and 132 and 133, respectively, are sputtered or otherwise deposited thereby forming respective sandwich-type transducer elements 110, 120 and 130. The thickness of the electrode material deposited on each planar face of layers 111, 121 and 131 need only be sufficient to conduct electricity (e.g., on the order of a few Angstroms), but can be made thicker to also act as a heat conductor or improve the transducer's mechanical stiffness.

Transducer 100 is composed of a multiplicity of transducer elements (e.g., transducer elements 110, 120 and 130) with electrical insulating film (e.g., film 140 and 150) between transducer elements such that each transducer element's electrode material is electrically isolated from the next transducer element's electrode material. Depending on the material selected for films 140 and 150, film 140 can also serve to bond transducer elements 110 and 120 to one another while film 150 can also serve to bond transducer elements 120 and 130 to one another. The bond between the insulating film and transducer elements can be implemented with either an adhesive or thermoplastic.

Transducer 100 is typically a cylindrical structure based on cylindrical transducer elements 110, 120 and 130 because this simplifies resonance mode analysis as will be recognized by one skilled in the art. However, transducer 100 can be constructed in accordance with other geometric shapes without departing from the scope of the present invention.

If transducer 100 is cylindrical as shown in FIG. 3, the electrode material sputtered, or otherwise deposited, on each planar face of layers 111, 121 and 131 is in the form of a circular piece. Generally, if transducer 100 is to be used for both generating and receiving acoustic energy, the electrode material on opposing faces of each layer 111, 121 and 131 is etched or cut so as to make a series or set of parallel strips which are electrically isolated from each other and whose orientation is the same on opposing planar faces of layers 111, 121 and 131.

The strips can extend over the totality of the electrode material on each planar face, however, for sake of simplicity, only three such strips are shown associated with each planar face of layers 111, 121 and 131. More specifically, strips 114, 116 and 118 on one planar face of layer 111 are respectively aligned over strips 115 (not visible in drawing), 117 and 119 (not visible in drawing) on the opposing planar face of layer 111. Similarly, strips 124, 126 and 128 on one planar face of layer 121 are respectively aligned over strips 125, 127 and 129 on the opposing planar face of layer 121, and strips 134, 136 and 138 on one planar face of layer 131 are respectively aligned over strips 135, 137 and 139 on the opposing planar face of layer 131.

Figure 4A:
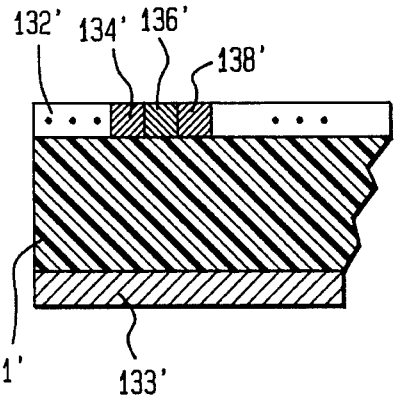
FIG. 4A is a view like FIG. 4 of a portion of an alternative embodiment of such transducer.

It is to be appreciated that if transducer 100 is only to be used as a transmitter, it may be configured with the set of parallel electrically isolated strips formed on only one face of the layers of transducer materials. This alternate embodiment is shown in FIG. 4A where transducer element 130' of a transducer unit has one of its electrical material layers 132' formed as a set of parallel electrically isolated strips 134' 136' and 138' The other electrode layer 133' is formed as a continuous piece providing a solid common ground in connection with operation of the transducer as a transmitter.

The center-to-center measurement W between adjacent electrode strips is determined by the desired frequency of operation and the resolution of the acoustic beam to be produced and potentially steered. In one embodiment of the invention, a useful degree of resolution of acoustic transducer directivity for beam steering applications at high acoustic frequencies (the meaning of which will be discussed in greater detail below) is achieved with an approximate center-to-center measurement on the order of 0.4λ, where λ is the wavelength of the desired frequency in the medium of the acoustic transmission. (Note that grating lobes develop as this measurement exceeds 0.5λ.) The underlying formula from which this approximation rule is implied will be discussed below.

All parallel electrode strips associated with a transducer element have the same angular orientation. Each transducer element is positioned such that the parallel electrode strips associated therewith define a unique angular orientation within transducer 100. By way of example, for the embodiment shown in FIG. 3, each of strips 114–119 is azimuthally oriented at a reference angle, i.e., 0° about reference pivot point A located where the central axis of cylindrical transducer 100 intersects the plane of the electrode strips. Each of strips 124–129 is oriented at an angle of 45° with respect to strips 114–119; and each of strips 134–139 is oriented at an angle of 90° with respect to strips 114–119. The center-to-center measurement W for adjacent strips in transducer 100 is defined generally $$W = \frac{C_{TRANSMISSION}}{2f} \tag{1}$$

where f is the frequency of operation for transducer 100, and $C_{TRANSMISSION}$ is the speed of sound in the acoustic transmission medium.

When each layer is excited, for example layer 111, acoustic pressure is emitted from both sides, i.e., the top and bottom opposing planar faces, of the layer. Since the layers below layer 111 (e.g., layers 121 and 131) are acoustically transparent, the pressure is effectively emitted from the bottom of layer 131 and from the top of layer 111. This mode of transmission is called bi-directional. In what is known as the uni-directional mode, transmission is limited to emission from only one radiating surface, e.g., the top of layer 111 but not the bottom of layer 131. The uni-directional mode is shown in the embodiment of FIG. 4 where transducer 100 is mounted on baffle 160 thereby limiting transmission emission (in this case) to the top of layer 111.

When layer 131 is excited in the uni-directional mode, acoustic energy emits successively up through transducer elements 120 and 110, and then on into the medium. Baffle 160 prevents acoustic emission from propagating downward from transducer element 130. When layer 111 is excited, the upward acoustic emission is as expected. However, since baffle 160 is a finite distance away from layer 111, i.e., the distance through transducer elements 120 and 130, there will be a partial reflection off baffle 160 which propagates through transducer element 110 and into the medium. Naturally, the reflected acoustic energy enters the medium with a slight delay relative to the original emission. This tends to obscure or smear (as it is known in the art) the signal being emitted from the top of transducer element 110. One approach used in the art for alleviating acoustic smear is to connect an energy absorption device to transducer 100. One such device is described in U.S. Pat. No. 5,371,801.

If baffle 160 is acoustically "soft" the product ρc of density ρ of the layer and acoustic sound speed c in the layer is much less than that of the transmission medium. For an acoustically "soft" baffle (e.g., a ρc product approaching that of air), the natural resonance of each layer of transducer 100 is the "half-wave resonance" and is related to its thickness t by the relationship $$t = \frac{C_{LAYER}}{2f} \tag{2}$$

where $C_{LAYER}$ is the speed of sound in the layer (e.g., layers 111, 121 and 131) of acoustically transparent electro-acoustic transducer material. If baffle 160 is acoustically "stiff" (e.g., a ρc product approaching that of a stiff metal such as tungsten), the resonance of each layer of transducer 100 is the "quarter-wave resonance" and is related to its thickness t by the relationship $$t = \frac{C_{LAYER}}{4f} \tag{3}$$

In general, acoustically "soft" is defined by a ρc product of baffle 160 that is much less (e.g., 10–100 times less) than the ρc product of the transmission medium. Conversely, acoustically "stiff" is defined as by a ρc product of baffle 160 that is much greater (e.g., 10–100 times greater) than the ρc product of the transmission medium.

Figure 5B:
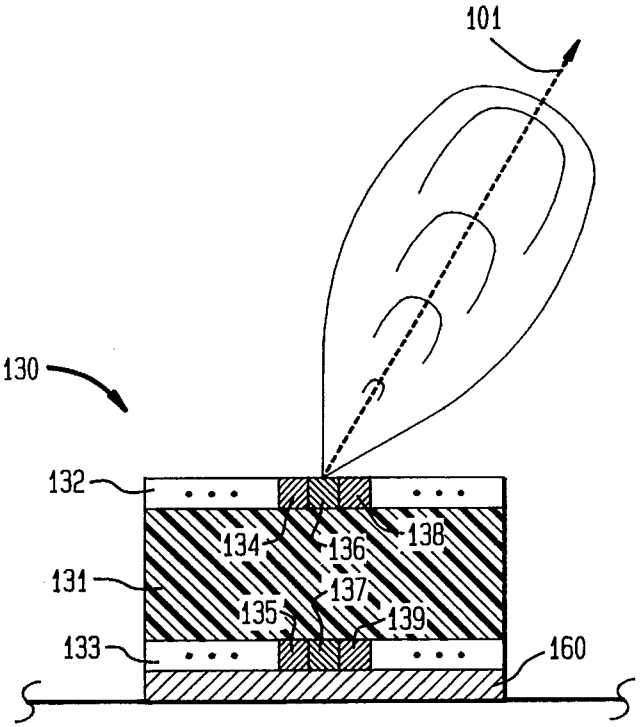
FIG. 5B is a somewhat diagrammatic, cross-sectional view of a single transducer element of the present invention shown with its beam pattern when the electrode strips are excited/sensitized in accordance with a known phasing technique.
Figure 5A:
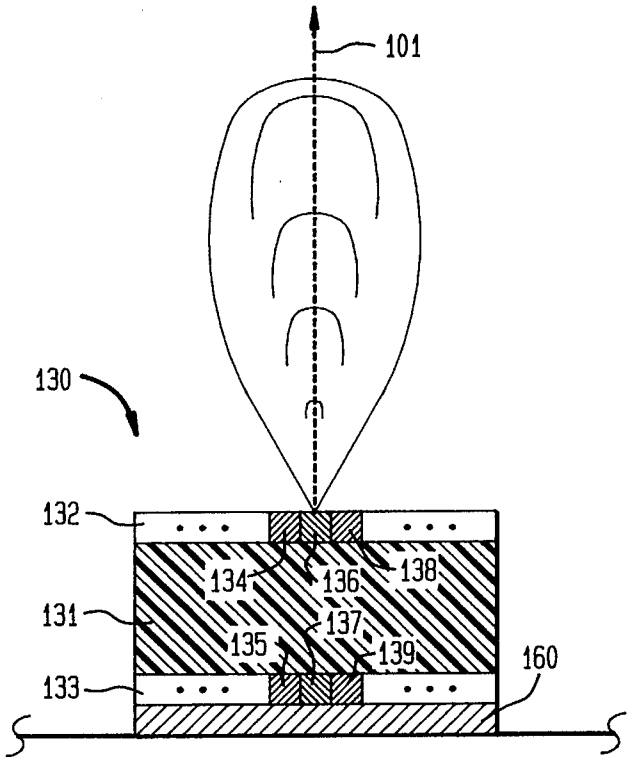
FIG. 5A is a somewhat diagrammatic, cross-sectional view of a single transducer element of the present invention shown with its beam pattern when all electrode strips are excited/sensitized simultaneously.

Each front face of a transducer element of the present invention is capable of directing/sensing acoustic energy along all elevations from 0°–180° defined along a hemispherical plane of sensitivity that is normal to the front face plane of the transducer element and perpendicular to the particular angular orientation of the transducer element's electrode strips. For example, if all electrode strips of transducer element 130 are excited/sensitized simultaneously, an acoustic beam pattern is generated/received over elevations along the transducer element's entire hemispherical plane of sensitivity. Maximum sensitivity is along the boresight axis which, in this case, lies at the elevation angle of 90° with respect to the front face plane of transducer element 130. This situation results in an acoustic beam pattern as shown in FIG. 5A where transducer element 130 is shown in isolation with its beam pattern. Maximum sensitivity is along a "normal-to-frontal-plane-boresight-axis" 101.

The sensitivity of transducer element 130 can be steered if the electrode strips associated therewith are excited/sensitized in accordance with some predefined sequence, i.e., phased. By phasing the electrode strips, it is possible for transducer element 130 to generate/receive an acoustic beam at specific angles of elevation along the transducer element's hemispherical plane of sensitivity. Maximum sensitivity is along a "steered- boresight-axis" 101' which has been pointed by beamforming system 500 (FIG. 3 described below) to an angle of elevation other than 90° along the hemispherical plane of sensitivity. This situation results in an acoustic beam pattern as shown in FIG. 5B where transducer element 130 is shown in isolation with its steered beam pattern.

To operate transducer 100, each strip electrode 114–119, 124–129 and 134–139 is electrically connected to electronic signal generator/detector beamforming system 500 as shown in FIG. 3. As is well known and will be appreciated by one skilled in the art, transducer 100 is a reciprocal device that is capable of reception of acoustic waves in a manner reciprocal to its use as a projector of acoustic waves. Thus, for transmission and reception operation, system 500 is typically of a type employing time delay coordinated or phase coordinated networks so that the beam patterns for each transducer element can be steered as described above and shown in FIGS. 5A and 5B. Such systems are conventional and well known and may be of any suitable type, as for example from among those described by J. L. Brown, Jr. and R. O. Rowlands in "Design of Directional Arrays" Journal of the Acoustical Society of America, Vol. 31, No. 12, December 1959, pages 1638–1643, or by R. J. Urick in "Principles of Underwater Sound" McGraw-Hill, New York, 1983, pages 54–70, which article and portion of a publication are incorporated herein in their entirety.

Figure 1:
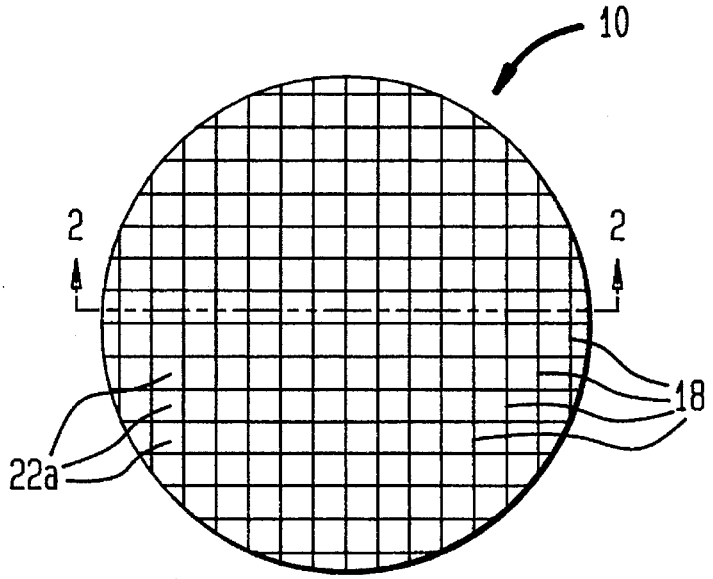
FIG. 1 (PRIOR ART)
FIG. 1 is a frontal plan view of a prior art piezoelectric ceramic transducer array.
Figure 2:
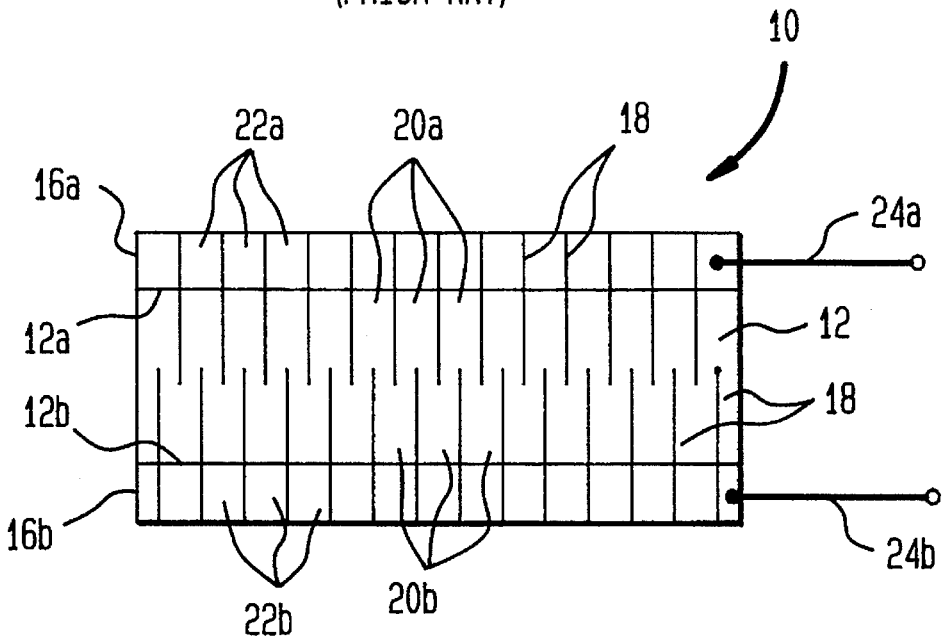
FIG. 2 (PRIOR ART)
FIG. 2 is a cross-sectional view of the prior art piezoelectric ceramic transducer array taken along line 2—2 of FIG. 1.

When transducer 100 is employed as an acoustic projector, it would be theoretically ideal for the sets of electrode strips associated with a transducer element to be totally isolated, in terms of acoustic interaction, from one another when receiving excitation from generator/detector system 500. However, in the case of the embodiment of transducer 100 (FIG. 1), which is a unitary construction of a number of transducer elements including transducer elements 110, 120 and 130, there are fringing effects transferred from the directly excited set of strips to the set of strips associated with the adjacent transducer element. The fringing effects may produce a spurious strain of the adjacent transducer element. This level of strain is acceptable for most applications of high-frequency steerable beam transducers. Also, judicious engineering can minimize the undesired effects of this spurious straining. One example of such minimization of undesired effects would be to design the transducer in accordance with the present invention, and further maximize the isolation of those parts with which fringing causes the most serious undesired effects. Another example of such minimization would be to design the transducer to exploit the second order effects produced by spurious strains to produce beneficial effects related to the desired beam directivity characteristics.

Figure 6:
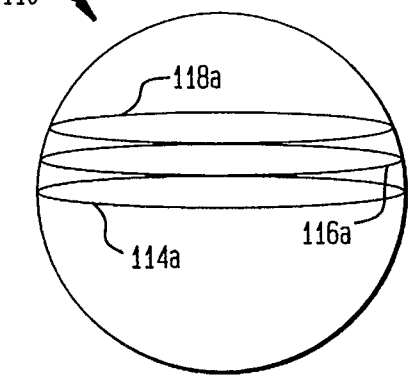
FIG. 6 is a frontal plan view of one transducer element's parallel strip arrangement useful in controlling the side lobe structure of the transducer's radiated beam.

If it is important to control the side lobe structure of the transducer's radiated beam, each parallel strip associated with a transducer element can be shaped in a symmetric fashion near each strip's outermost ends. This effectively reduces the amount of acoustic energy emitted near the ends of each strip. One example of such strip shaping is shown in FIG. 6 where the frontal plan view of transducer element 110 now depicts strips 114*a*, 116*a*, and 118*a* tapered symmetrically at each end thereof. This technique is known in the art as shading the array.

The advantages of the present invention are numerous. The simple stacked configuration provides a steerable acoustic transducer for acoustic signal generation and/or detection that avoids the problems associated with current steerable acoustic transducers. For example, the above-described prior art 20×20 array could be replaced by a stacked set of 20 transducer elements in accordance with the present invention. Each transducer element could have its layer of acoustically transparent electro-acoustic transducer material with 20 parallel electrode strips on each layer. The 20 transducer elements would be stacked such that their azimuthal orientations are uniformly spaced through 360° (i.e., each transducer element's strips are offset from an adjacent transducer element's strips by 18° ). The total number of wires required for connection to the electrode strips is still 400, however, because the connections are made on the end of the strips, there are no wires interfering with the front face plane of the transducer. If more precision is needed in terms of steering direction, additional transducer elements at different orientations can be added to the stack.

Figure 7:
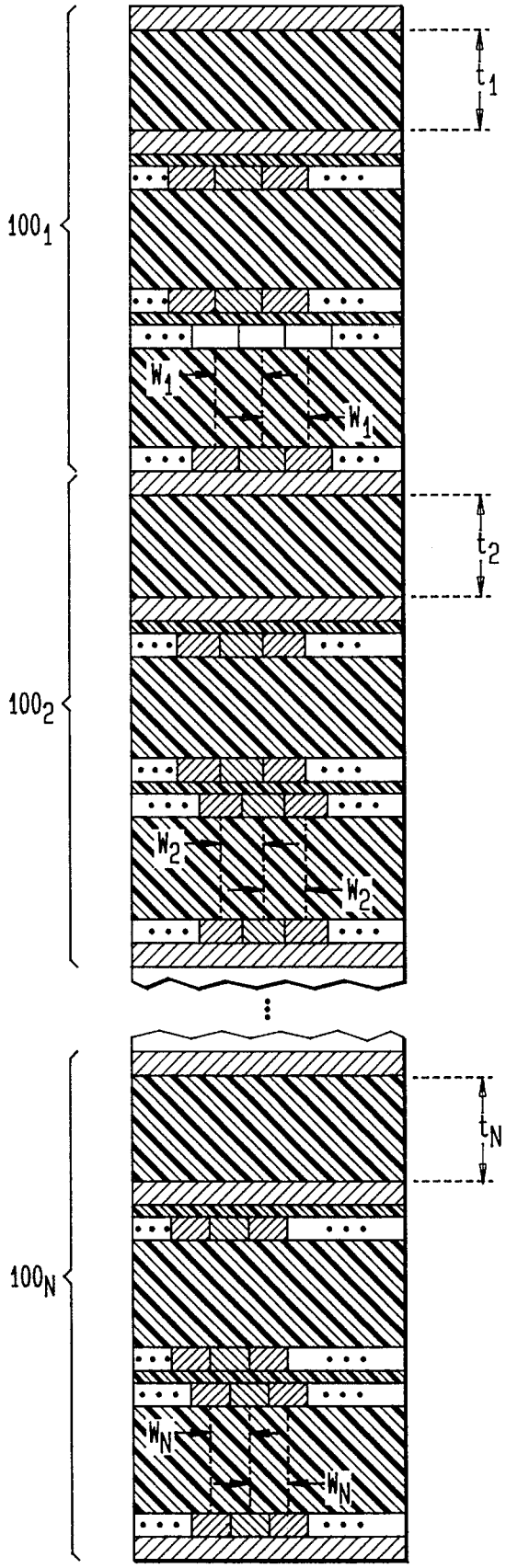
FIG. 7 is a cross-sectional view of the multiple frequency multiple layer steerable acoustic transducer according to the present invention.

In order to achieve a multiple frequency steerable acoustic transducer, multiple transducers $\mathbf{100}_1$, $\mathbf{100}_2$, . . . , $\mathbf{100}_N$ are stacked on one another as shown in FIG. 7. Each transducer $\mathbf{100}_1$, $\mathbf{100}_2$, . . . , $\mathbf{100}_N$ is similar in construction to transducer 100 except that the thicknesses $t_1$, $t_2$, . . . , $t_N$ of the respective acoustically transparent electro-acoustic transducer material layers and respective strip widths $W_1$, $W_2$, . . . , $W_N$ are optimized for each transducer $\mathbf{100}_1$, $\mathbf{100}_2$, . . . , $\mathbf{100}_N$ in accordance with the above-noted equations using the respective frequencies of operation $f_1$, $f_2$, . . . , $f_N$.

While a transducer in accordance with the present invention is useful for operation at all frequencies, its construction has special utility for operation at high frequencies where it has heretofore been difficult to provide the desired compactness and miniaturization of design. By way of example, high-frequency operation for underwater sound applications is defined by the range 20–80 kHz while high-frequency operation in the fields of medical ultrasonic testing and examinations is defined as greater than 250 kHz. The structure of the present invention is well suited for both such "high-frequency" situations where size constraints for optimum performance are paramount. Towards the end of minimizing size of the transducer, the present invention is well-suited to thin-film techniques for the manufacture of a unitary structure from a plurality of thin-film layers. For example, the layers of acoustically transparent electro-acoustic transducer material may be fabricated using conventional techniques of casting thin sheets in shallow molds. The thin films of conductive metal can (i) be sputtered or otherwise deposited on the planar faces of the layers of acoustically transparent electro-acoustic transducer material, and (ii) etched or scored to form the electrode strips. The resultant sandwich-type transducer elements are stacked and bonded together by either an adhesive or thermoplastic bonding agent.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A multiple frequency acoustic transducer comprising:

a stacked configuration of N groups of multi-layer transducer elements separated from one another by an electrical insulating material, each of said multi-layer transducer elements from an n-th one of said N groups having a layer of acoustically transparent electro-acoustic transducer material of selected thickness $t_n$ determined as a function of the speed of sound $C_{LAYER}$ in said layer of acoustically transparent electro-acoustic transducer material of selected thickness $t_n$ and a desired frequency of operation $f_n$;

each of said multi-layer transducer elements from an n-th one of said N groups having opposing planar surfaces with electrically conductive material deposited thereon;

said electrically conductive material on at least one of said opposing planar surfaces for each of said multi-layer transducer elements being formed into parallel strips electrically isolated from one another; and said parallel strips associated with each of said multi-layer transducer elements in said n-th one of said N groups having a unique angular orientation in said n-th one of said N groups.

2. A multiple frequency acoustic transducer as in claim 1 wherein said acoustically transparent electro-acoustic transducer material is selected from the group consisting of urethane, nylon, polyvinylidene fluoride, and polyvinylidene trifluoroethylene.

3. A multiple frequency acoustic transducer as in claim 1 wherein said electrically conductive material is metal.

4. A multiple frequency acoustic transducer as in claim 1 wherein adjacent ones of said parallel strips of electrically conductive material associated with each of said multi-layer transducer elements from said n-th one of said N groups have a center-to-center measurement $W_n$ based on the relationship $$W_n = \frac{C_{TRANSMISSION}}{2f_n}$$

where $C_{TRANSMISSION}$ is the speed of sound in a transmission medium in which said acoustic transducer is to operate.

5. A multiple frequency acoustic transducer as in claim 1 wherein adjacent ones of said parallel strips of electrically conductive material associated with each of said multi-layer transducer elements have a center-to-center measurement $W_n$ of approximately $0.4\lambda n$, where $\lambda_n$ is the wavelength of said desired frequency of operation $f_n$.

6. A multiple frequency acoustic transducer as in claim 1 wherein said stacked configuration is cylindrical.

7. A multiple frequency acoustic transducer as in claim 1 further comprising a baffle on which said stacked configuration is mounted.

8. A multiple frequency acoustic transducer as in claim 7 wherein said baffle is acoustically soft.

9. A multiple frequency acoustic transducer as in claim 8 wherein said thickness $t_n$ is defined by the relationship $$t_n = \frac{C_{LAYER}}{2f_n}.$$

10. A multiple frequency acoustic transducer as in claim 7 wherein said baffle is acoustically stiff.

11. A multiple frequency acoustic transducer as in claim 10 wherein said thickness $t_n$ is defined by the relationship $$t_n = \frac{C_{LAYER}}{4f_n}.$$

12. A multiple frequency acoustic transducer as in claim 1 wherein said electrically conductive material on both said opposing planar surfaces of each of said multi-layer transducer elements in each said n-th one of said N groups are formed into said parallel strips.

13. A multiple frequency acoustic transducer as in claim 1 wherein said electrically conductive material on only one of said opposing planar surfaces of each of said multi-layer transducer elements in each said n-th one of said N groups is formed into said parallel strips, said electrically conductive material on the other of said opposing planar surfaces being a continuous piece forming a common ground in connection with operation of said acoustic transducer as a transmitter.

* * * * *